US009839256B2

(12) United States Patent
Campari

(10) Patent No.: US 9,839,256 B2
(45) Date of Patent: Dec. 12, 2017

(54) SPORTS SHOE, PARTICULARLY FOR SOCCER USE AND THE LIKE

(71) Applicant: Enrico Campari, Felino (IT)

(72) Inventor: Enrico Campari, Felino (IT)

( * ) Notice: Subject to any disclaimer, the term of this patent is extended or adjusted under 35 U.S.C. 154(b) by 342 days.

(21) Appl. No.: 14/358,263

(22) PCT Filed: Nov. 9, 2012

(86) PCT No.: PCT/EP2012/072322
§ 371 (c)(1),
(2) Date: May 15, 2014

(87) PCT Pub. No.: WO2013/072260
PCT Pub. Date: May 23, 2013

(65) Prior Publication Data

US 2014/0310995 A1 Oct. 23, 2014

(30) Foreign Application Priority Data

Nov. 17, 2011 (IT) ..... MI2011A2089

(51) Int. Cl.
*A43C 15/00* (2006.01)
*A43B 5/00* (2006.01)
(Continued)

(52) U.S. Cl.
CPC ..... *A43B 5/02* (2013.01); *A43C 15/08* (2013.01); *A43C 15/14* (2013.01); *A43C 15/161* (2013.01); *A43C 15/168* (2013.01)

(58) Field of Classification Search
CPC ..... A43C 15/08; A43C 15/14; A43C 15/161; A43C 15/168; A43B 5/02
(Continued)

(56) References Cited

U.S. PATENT DOCUMENTS 4,470,207 A * 9/1984 Bente ..... A43C 15/168 36/134
4,873,774 A * 10/1989 Lafever ..... A43C 15/14 36/134
(Continued)

FOREIGN PATENT DOCUMENTS

EP 0081067 A2 6/1983
EP 0451379 A1 10/1991
(Continued)

OTHER PUBLICATIONS

Japanese Office Action issued in corresponding case No. JP 2014-541614; dated Jun. 28, 2016; 5 pages.
(Continued)

*Primary Examiner* — Clinton T Ostrup
*Assistant Examiner* — Cameron A Carter
(74) *Attorney, Agent, or Firm* — Brooks Kushman P.C.

(57) ABSTRACT

A sports shoe, particularly for soccer use and the like, comprising an upper and a sole which is provided with one or more studs, each stud being associated with the sole by way of at least one elastically deformable element for the movement of at least part of the stud about its own longitudinal axis in such a manner as to follow the movements of change of direction, traction and stopping of the athlete who is wearing the sports shoe, the sports shoe further comprising a stripping prevention element that lies inside the sole and the stud, passing through the elastically deformable element in order to prevent accidental breakages of the elastically deformable element and/or the separation of the stud during the use of the sports shoe.

7 Claims, 5 Drawing Sheets

(51) Int. Cl.

| | |
|---|---|
| ***A43B 5/02*** | (2006.01) |
| ***A43C 15/08*** | (2006.01) |
| ***A43C 15/14*** | (2006.01) |
| ***A43C 15/16*** | (2006.01) |

(58) Field of Classification Search
USPC ..... 36/134, 61, 62, 67 A, 67 D
See application file for complete search history.

(56) References Cited

U.S. PATENT DOCUMENTS

| | | | | | |
|---|---|---|---|---|---|
| 5,289,647 | A * | 3/1994 | Mercer | A43C 15/168 | 36/134 |
| 5,321,901 | A * | 6/1994 | Kelly | A43C 15/161 | 36/134 |
| 5,337,494 | A * | 8/1994 | Ricker | A43C 15/14 | 36/134 |
| 5,351,422 | A * | 10/1994 | Fitzgerald | A43B 5/001 | 36/134 |
| 5,617,653 | A * | 4/1997 | Walker | A43B 13/26 | 36/128 |
| 6,481,122 | B2 * | 11/2002 | Brahler | A43C 15/165 | 36/127 |
| 6,739,075 | B2 * | 5/2004 | Sizemore | A43B 13/182 | 36/61 |
| 2002/0178619 | A1 * | 12/2002 | Schaudt | A43B 13/26 | 36/128 |
| 2005/0198868 | A1 * | 9/2005 | Scholz | A43B 3/24 | 36/67 D |
| 2008/0066348 | A1 * | 3/2008 | O'Brien | A43B 5/001 | 36/100 |
| 2011/0252664 | A1 * | 10/2011 | Jennings | A43B 5/02 | 36/28 |
| 2012/0260535 | A1 * | 10/2012 | Tsang | A43B 13/26 | 36/32 R |
| 2013/0031807 | A1 * | 2/2013 | Gerber | A43C 15/161 | 36/134 |

FOREIGN PATENT DOCUMENTS

| | | | |
|---|---|---|---|
| GB | 2257616 | A | 1/1993 |
| JP | S5195442 | | 7/1976 |
| JP | S5814701 | U | 1/1983 |
| JP | S5897301 | A | 6/1983 |
| JP | S59150310 | U | 10/1984 |
| JP | H04-003006 | U | 1/1992 |
| JP | 2007312856 | A | 12/2007 |
| WO | 2005079616 | A1 | 9/2005 |
| WO | 2010133454 | A1 | 11/2010 |

OTHER PUBLICATIONS

Japanese Office Action issued in corresponding case No. JP 2014-541614; dated Jun. 28, 2016; 7pages; English Translation.

Italian Search Report dated Aug. 10, 2012 for Italian Application No. IT MI2011A002089 filed Nov. 17, 2011, 2 pages.

International Search Report dated Mar. 6, 2013 for International Application No. PCT/EP2012/072322 filed Nov. 9, 2012, 4 pages.

* cited by examiner

SPORTS SHOE, PARTICULARLY FOR SOCCER USE AND THE LIKE

CROSS-REFERENCE TO RELATED APPLICATION

This application is the U.S. national phase of PCT Application No. PCT/EP2012/072322 filed on Nov. 9, 2012, which claims priority to Italian Patent Application No. MI2011A002089 filed on Nov. 17, 2011, the disclosures of which are incorporated in their entirety by reference herein.

The present invention relates to a sports shoe, particularly for soccer use and the like.

In many sporting disciplines which involve running on grassy terrain, such as for example soccer and rugby, the use is known of special shoes which enable the athlete to have excellent traction between sole and ground so as to prevent unwanted slipping while the sporting activity is in progress.

More specifically, sports shoes are known which have spikes or studs on the tread side of the sole, which consist of a plurality of rigid studs that are fixed integrally to the sole.

In this way, the weight of the athlete is discharged completely onto such studs, making them sink into the ground and allowing the athlete to make stopping or traction movements or changes of direction even on particularly slippery terrain.

Though the market is capable of offering a wide range of sports shoes with studs, such shoes exhibit a common drawback in that, under particular conditions of traction in which the shoe is strongly engaged with the ground, the athlete's kinetic energy is discharged on the joints of the athlete's lower limbs, leading to muscular fatigue and, in some cases, even to problems of greater or lesser seriousness which translate to injuries.

More precisely, such conventional sports shoes, by not being capable of absorbing and/or discharging the thrust forces between the ground and the shoe proper, can cause spraining of the ankle and/or knee joints and/or straining of the ligamentous structures affecting such joints.

For example, a soccer player during normal sporting activity moves mainly by way of running with continuous changes of direction which are repeated over time, with a high frequency, including work steps of concentric and eccentric type which are executed at high speeds, just as the steps of acceleration and stopping can be.

Since the cruciate ligaments are the ligamentous structures of the knee that are most sensitive to twisting movements and, in particular, given the central position of the anterior cruciate ligament and its function in the stability of the knee, together with the collateral ligaments, these are frequently subjected to stress, micro-trauma, lesion and total rupture, all induced by the torsion/flexion movements which stimulate them.

More specifically, valgus traumas with outer rotation can cause lesions to the inner collateral ligament, the posterior oblique ligament and the anterior cruciate ligament.

Moreover, varus traumas with inner rotation can cause lesions to the anterior cruciate ligament and can also cause anterolateral and posterolateral capsular-ligamentous lesions.

More precisely, the anterior cruciate ligament, by way of its sophisticated structure of bundles of fibers which have different lengths and directions, provides stability on the sagittal and frontal plane of the knee joint by aiding in the rolling and sliding movement of the bone extremities in flexion and extension and actively controlling the rotation movement, both in flexion and in extension, of the leg in order to maintain the stability of the knee in rotation.

The anterior cruciate ligament moreover prevents excessive anterior translational movements of the tibia and the entrainment of the femur on the tibia when the latter is locked and, vice versa, is stressed by the load when the femur is locked and the tibia is mobile.

Trauma to the anterior cruciate ligament is in most cases caused by a movement in which the tibia remains locked and the femur is mobile, thus executing the movement commonly referred to as "foot planted on the ground".

Such trauma is due to the fact that there is an exponential and continuous engagement which depends on the cruciate ligament owing to the contraction of the quadriceps muscle both in flexion and in extension.

In order to overcome such drawback, in recent years a damping system has been devised which is applied to the sports shoe and is capable of at least partially absorbing the work released during the steps of stopping, traction and/or change of direction described previously.

More precisely, such damping system consists of the interposition of elastically deformable material between the sole and the studs.

In this way, the work released during the steps of stopping, traction and/or change of direction is absorbed by such elastically deformable material, thus safeguarding the athlete's joints.

Conventional sports shoes provided with such damping systems are also not devoid of drawbacks, among which is the fact that, under particular heavy conditions, the cutting and flexion force to which the elastically deformable material is subjected can lead to its being stripped and to the loss of the stud with which it is associated.

The aim of the present invention consists in providing a sports shoe, particularly for soccer use and the like, which makes it possible to prevent and avoid injuries to the entire joint system of the lower limbs, without depriving the athlete who is wearing the shoes of the essential perceptions of traction between the shoe and the ground that the athlete demands when practising sport, and which above all is capable of withstanding the continuous stresses to which it is subjected.

Within this aim, an object of the present invention consists in providing a sports shoe that improves stability in the kinematics of movement of the athlete's lower limb.

This aim and these and other objects which will become better apparent hereinafter are achieved by a sports shoe, particularly for soccer use and the like, comprising an upper and a sole which is provided with at least one stud, said at least one stud being associated with said sole by means of at least one elastically deformable element for the movement of at least part of said at least one stud about its own longitudinal axis in such a manner as to follow the movements of change of direction, traction and stopping of the athlete who is wearing the sports shoe, characterized in that it comprises a stripping prevention element that lies inside said sole and said at least one stud, passing through said at least one elastically deformable element in order to prevent accidental breakages of said at least one elastically deformable element and/or the separation of said at least one stud during the use of said sports shoe.

Further characteristics and advantages of the present invention will become better apparent from the description of four preferred, but not exclusive, embodiments of a sports shoe, particularly for soccer use and the like, according to the invention, which are illustrated for the purposes of non-limiting example in the accompanying drawings wherein.

Figure 1:
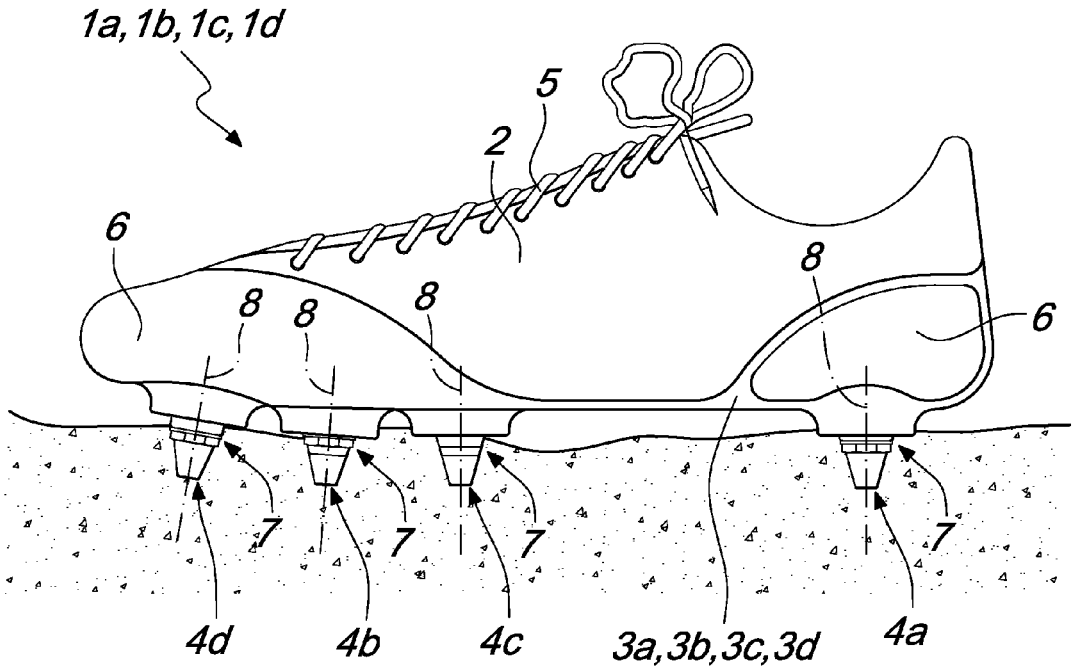
FIG. 1 is a schematic side elevation view of a sports shoe, particularly for soccer use and the like, which has all the characteristics of the four embodiments proposed according to the invention.
Figure 2:
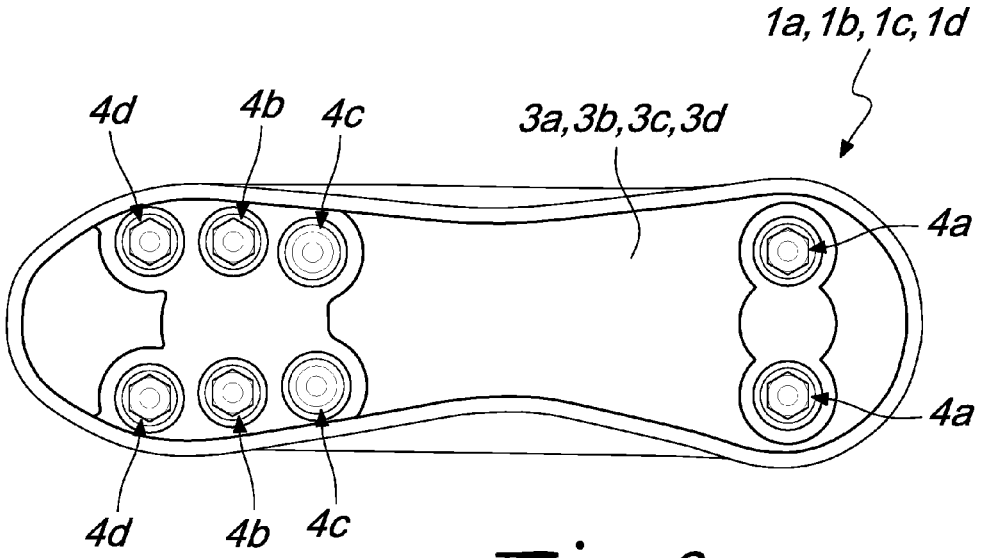
FIG. 2 is a view from below of the sports shoe shown in FIG. 1.

With reference to the figures, the sports shoe, particularly for soccer use and the like, which is generally designated in the four proposed embodiments with the reference numerals 1*a*, 1*b*, 1*c* and 1*d*, comprises an upper 2 and a sole 3*a*, 3*b*, 3*c* or 3*d* which is provided with studs 4*a*, 4*b*, 4*c* or 4*d*.

More specifically, the upper 2, in all the embodiments, can have a front opening that can be closed by means of laces 5 or tear-off closing systems and can be provided with lateral and frontal reinforcements 6 where the impact with the ball occurs.

Conveniently, as will be better described hereinafter, each stud 4*a*, 4*b*, 4*c* or 4*d* is associated with the respective sole 3*a*, 3*b*, 3*c* or 3*d* by way of at least one elastically deformable element 7 for the movement of at least part of at least one stud 4*a*, 4*b*, 4*c* or 4*d* about its own longitudinal axis 8 in such a manner as to follow the movements of change of direction, traction and stopping of the athlete who is wearing the sports shoe 1*a*, 1*b*, 1*c* or 1*d*.

According to the invention, all the proposed embodiments have a stripping prevention element 9 that lies inside the sole 3*a*, 3*b*, 3*c* or 3*d* and the stud 4*a*, 4*b*, 4*c* or 4*d*, passing through the elastically deformable element 7 substantially along the longitudinal axis 8 in order to prevent accidental breakages thereof and/or the separation of the stud 4*a*, 4*b*, 4*c* or 4*d* during the use of the sports shoe 1*a*, 1*b*, 1*c* or 1*d*.

Figure 3:
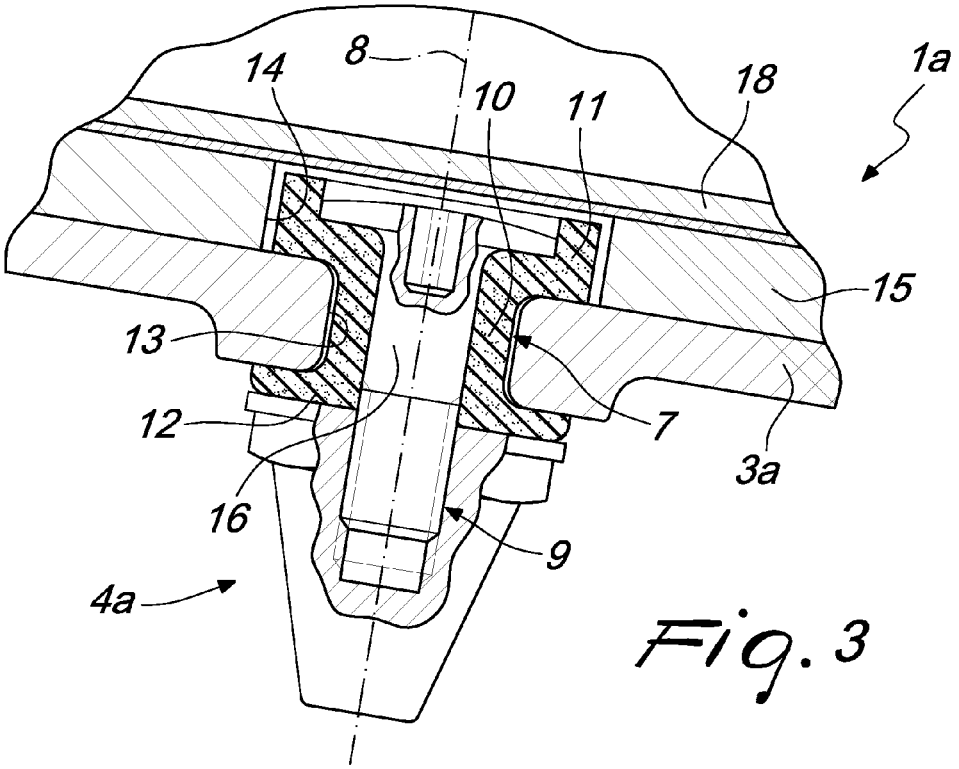
FIG. 3 is a sectional view of a detail of a stud, not subjected to external stresses, of the first embodiment of the sports shoe according to the invention.
Figure 4:
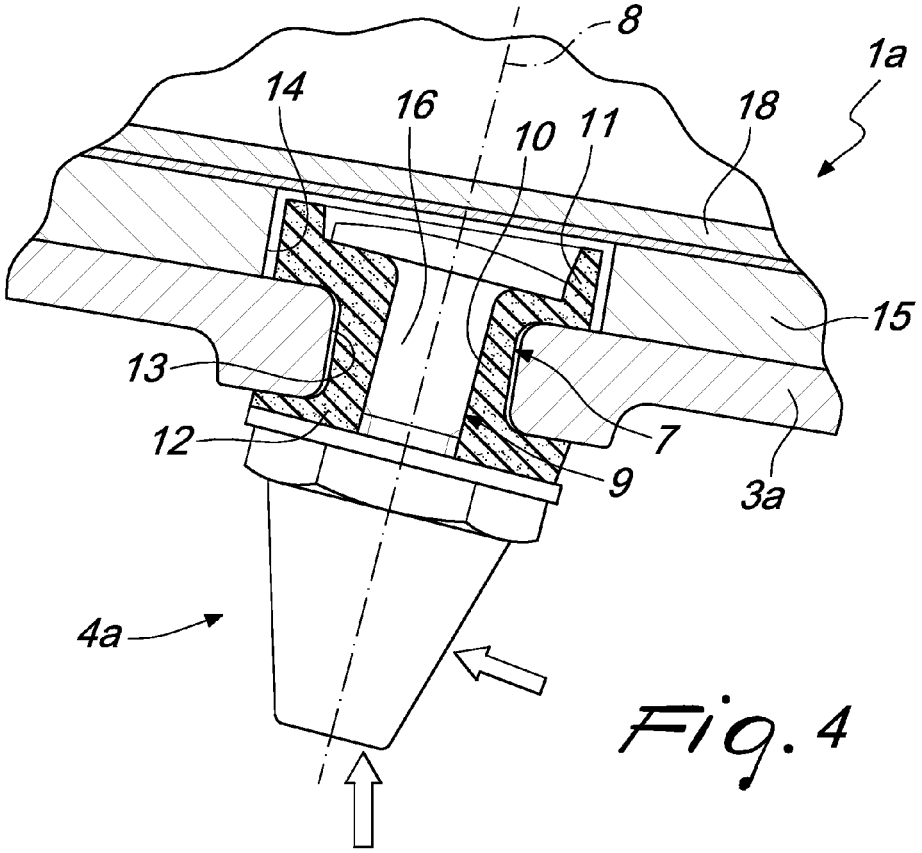
FIG. 4 is a sectional view of a detail of the stud shown in FIG. 3, subjected to external stresses.

With particular reference to FIGS. 3 and 4, in the first embodiment proposed, in the sports shoe 1*a* the elastically deformable element 7 is defined by a collar element 10 which has, at its axial ends, two radial flanges 11 and 12.

More precisely, the collar element 10 passes from one side of the sole 3*a* to the other by means of a through hole 13 which is defined in the sole 3*a* so that the sole 3*a* remains interposed between the two radial flanges 11 and 12.

In this manner, the radial flange 11 arranged inside the sports shoe 1*a* remains accommodated in a compartment 14 which is defined in the compensation mid-sole 15 of the sports shoe 1*a* and the radial flange 12 arranged on the tread side of the sole 3*a* is associated with stud 4*a* which is frustum-shaped.

Considering the stripping prevention element 9, in this first embodiment this is defined by a screw 16 which is inserted in the collar element 10 on the side of the radial flange 11, removing the inner sole 18, and is screwed into a respective threaded hole 17 which is defined in the stud 4*a*.

Figure 5:
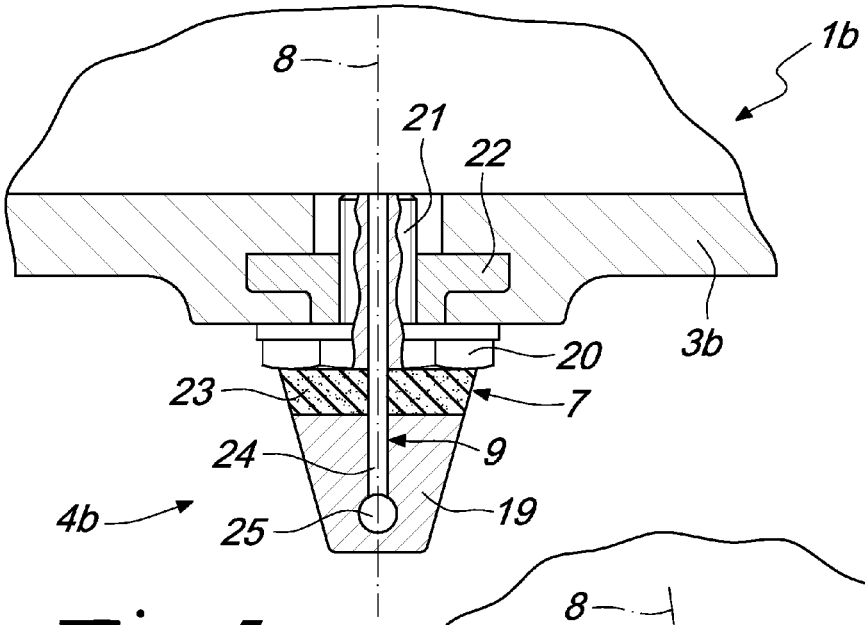
FIG. 5 is a sectional view of a detail of a stud, not subjected to external stresses, of the second embodiment of the sports shoe according to the invention.
Figure 6:
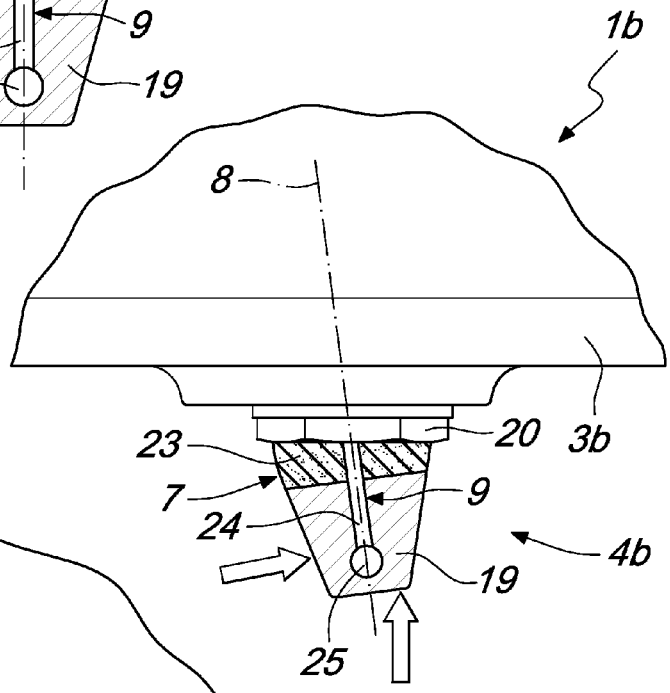
FIGS. 6 and 7 are sectional views of a detail of the stud shown in FIG. 5, subjected to external stresses.
Figure 7:
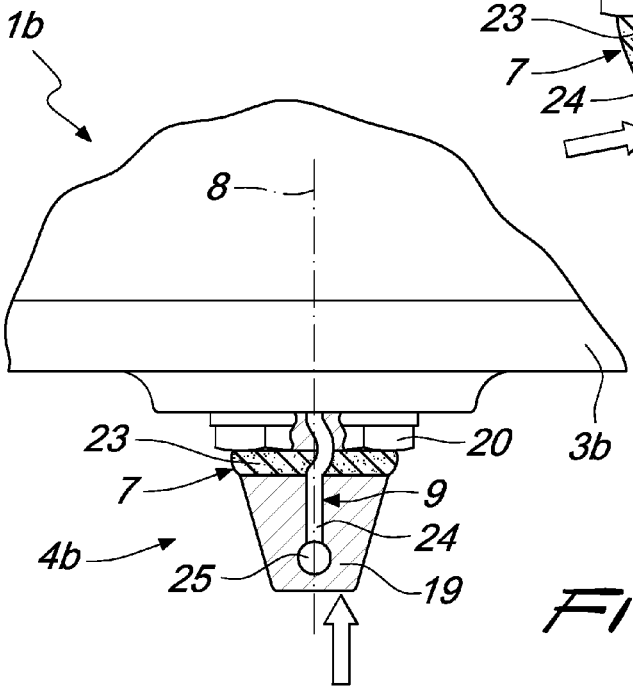

Differently, with particular reference to FIGS. 5 to 7, in the second embodiment proposed, in the sports shoe 1*b* the stud 4*b* is defined by a first end portion 19, which is frustum-shaped, and by a second disk-like portion 20 which has an outer profile that is adapted to be engaged by screwing means, for example by a hexagonal key.

More precisely, the stud 4*b* is provided with a threaded shank 21 that protrudes from the second disk-like portion 20 and is screwed into a threaded pawl 22 that is associated with the sole 3*b* on the tread side.

Considering the elastically deformable element 7 and the stripping prevention element 9, these are defined, respectively, by a disk-like element 23 which is interposed between the first end portion 19 and the second disk-like portion 20 and by a flexible cable 24 which is associated with the second disk-like portion 21, and passes through the disk-like element 22 substantially along the longitudinal axis 8 and is provided with an end 25 which is embedded in the first end portion 19.

More precisely, the end 25 has a radially expanded shape structure, substantially spherical, and the flexible cable 24 is made of steel.

Figure 8:
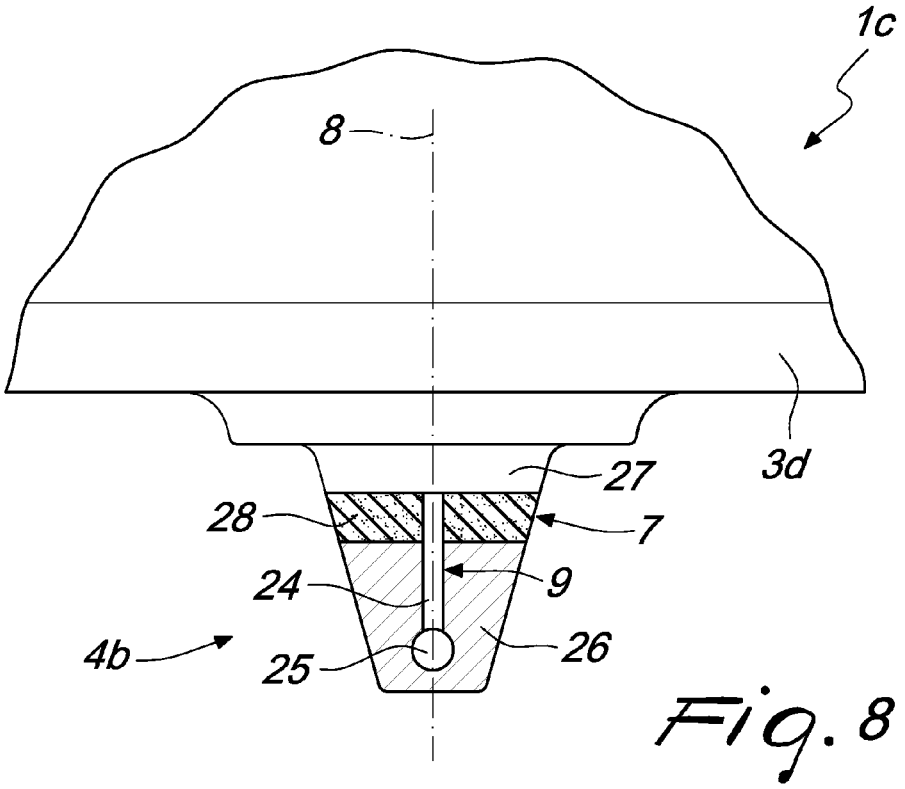
FIG. 8 is a sectional view of a detail of a stud, not subjected to external stresses, of the third embodiment of the sports shoe according to the invention.
Figure 9:
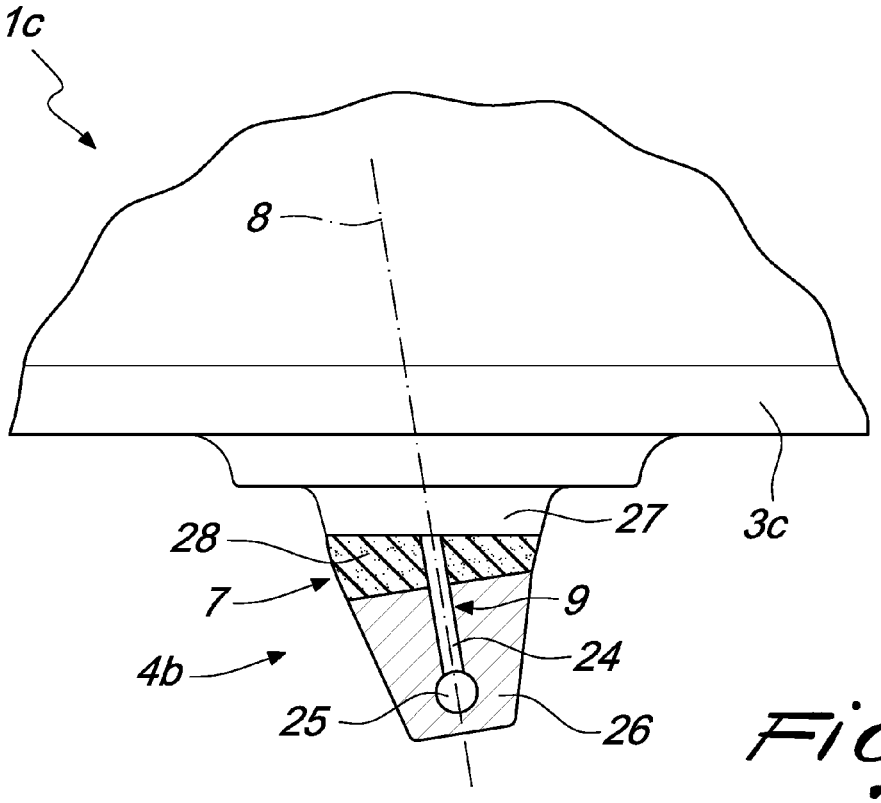
FIG. 9 is a sectional view of a detail of the stud shown in FIG. 8, subjected to external stresses.

With particular reference to FIGS. 8 and 9, in the third embodiment proposed, in the sports shoe 1*c* the stud 4*c* is defined by a first end portion 26, which is frustum-shaped, and by a second disk-like portion 27 which is integral with the sole 3*c*.

Similarly to the second embodiment, the elastically deformable element 9 and the stripping prevention element 7, are defined, respectively, by a disk-like element 28 which is interposed between the first end portion 26 and the second disk-like portion 27 and by a flexible cable 24 which is associated with the second disk-like portion 27, and passes through the disk-like element 28 substantially along the longitudinal axis 8 and is provided with an end 25 which is embedded in the first end portion 26.

More precisely, the end 25 has a radially expanded shape structure, substantially spherical, and the flexible cable 24 is made of steel.

Figure 10:
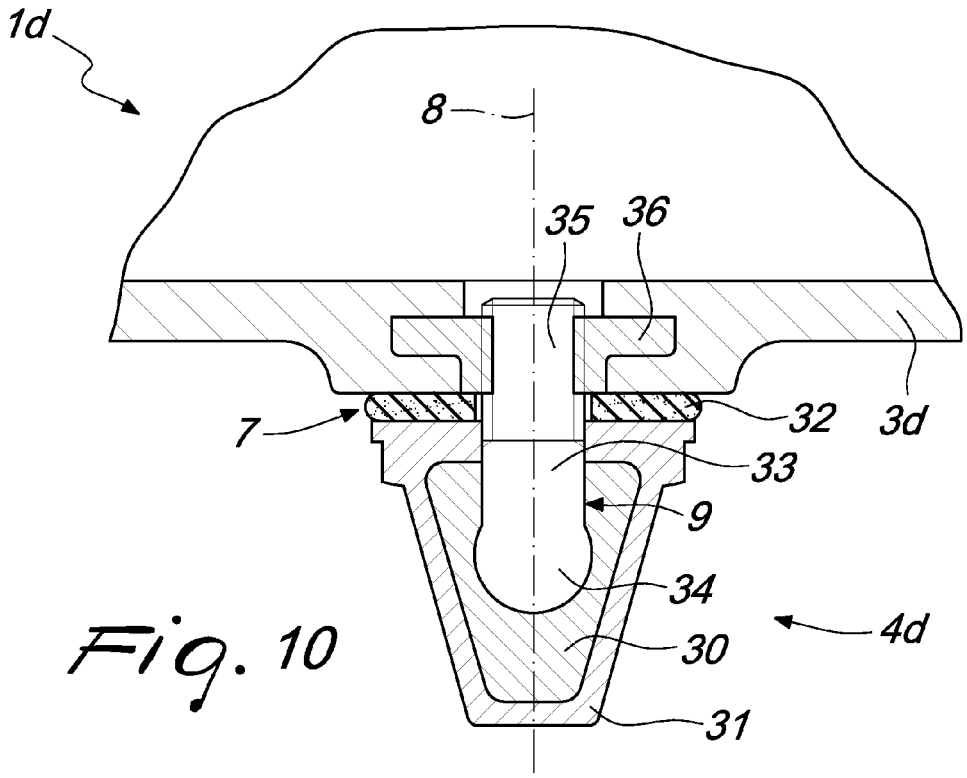
FIG. 10 is a sectional view of a detail of a stud, not subjected to external stresses, of the fourth embodiment of the sports shoe according to the invention.
Figure 11:
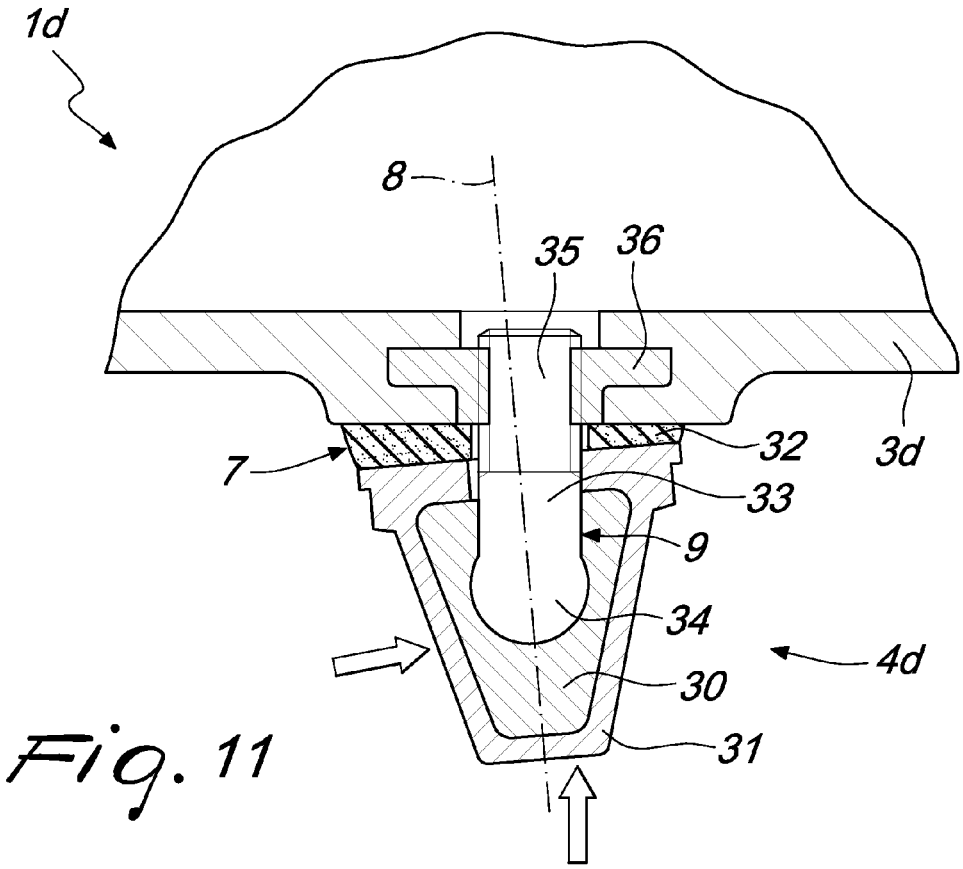
FIG. 11 is a sectional view of a detail of the stud shown in FIG. 10, subjected to external stresses.

With particular reference to FIGS. 10 and 11, in the fourth embodiment proposed, in the sports shoe 1*d* the stud 4*d* is defined by an inner part 30 which is made of an elastically deformable material and by an outer shell 31, which is frustum-shaped and is made of a rigid material and is provided with an outer profile that is adapted to be engaged by screwing means, for example by a hexagonal key.

The elastically deformable element 7 is defined by a disk-like element 32 which is interposed between the outer shell 31 and the sole 3*d*.

Considering the stripping prevention element 9, this is defined by a pin 33 which has, at one end, a spherical head 34 which is embedded in the inner part 30 of the stud 4*d* and, at the other end, a threaded shank 35 that protrudes from the outer shell 31 and passes through the disk-like element 32 substantially along the longitudinal axis 8 and is screwed into a threaded pawl 36 that is associated with the sole 3*d* on the tread side.

Operation of the sports shoes 1*a*, 1*b*, 1*c* and 1*d* is the following.

In the first embodiment 1*a*, as shown in FIG. 1, when the stud 4*a* is subjected to an external lateral stress to the sole 3*a*, the stud 4*a* is forced to incline laterally, thus forcing the screw 16 to incline as well. Such inclinations lead to the partial compression of the collar 10 and of the two radial flanges 11 and 12 which, by deforming elastically, absorb part of the athlete's kinetic energy thus safeguarding him/her from injury.

Differently, in the second embodiment 1*b* and in the third embodiment 1*c*, when the studs 4*b* and 4*c* are subjected to an external lateral stress, they tend to rotate, thus deforming the respective disk-like element 23 and 28.

The hold between the stud 4*b* and 4*c* and the respective disk-like element 22 or 27 is ensured by the flexible cable 24 which deforms without breaking.

With particular reference to FIG. 7, in the event of compression stress only, the flexible cable 24 can curve and then return to assume a straight form when the stress has ended.

Similarly, with reference to FIG. 11, in the fourth embodiment 1*d*, the stud 4*d*, when it is subjected to an external lateral stress, tends to rotate about the spherical head 34 of the pin 33 which acts as a joint.

During such rotation, the disk-like element 32 deforms elastically, absorbing part of the athlete's kinetic energy thus safeguarding him/her from injury.

In fact, in all the embodiments proposed, the studs 4*a*, 4*b*, 4*c* and 4*d*, thanks to the elastically deformable element 7, make it possible for the sports shoes 1*a*, 1*b*, 1*c* and 1*d* to accompany the athlete's change of direction movement thus making his/her athletic movement more natural and harmonic.

More precisely, the equilibrium and thrust of the athlete during the change of direction are localized at the first metatarsus of the foot; the position of the studs 4*a*, 4*b*, 4*c* and 4*d* in this region favors better safety for athletes in multi-directional movements, but above all it enables the athlete to better respond to the negative forces of friction that arise in change of direction while maintaining good coordination with a modulability of the force exerted by the athlete on the ground, or vice versa.

Completing a sudden change of direction with full stability and with maximum coordination means optimizing the forces involved in favor of performance and prevention.

In practice it has been found that the sports shoe, particularly for soccer use and the like, according to the present invention, fully achieves the intended aim and objects in that it makes it possible to decrease the risk of injury by ensuring a correct stability of the foot without being subjected to structural weakening.

In more detail, in the rotation step of any change of direction, the elastic deformability of the stud, or of at least part of it, reduces the angle of rotation in the rotary movements between femur and tibia and reduces the angle of rotation of the ankle so as to limit the load applied on the anterior cruciate ligament and the twisting stress applied to the knee joint.

The rotation of the shoe with respect to the ground makes it possible to maintain better stability of the axes of the body and confers better directivity and safety on the movement.

Moreover, during rotation of the knee joint, with the aid of the stud according to the invention, locking of the tibia is reduced thus making it freer to follow the rotation movement induced by the femur and thus avoiding ending up in the condition that most frequently results in indirect traumas to the knee joint, which consists in having the foot planted on the ground, the tibia locked and the femur mobile.

Moreover, in consideration of the fact that in the change of direction, the load point is at the first metatarsus on the antero-inner side of the foot, the stud according to the invention positioned in this thrust area, by means of its elastic deformability, enables a movement that is directed toward the effective direction of travel.

With regard to prevention of injury, including substantial injury, the stud according to the invention is an efficient injury prevention element in that makes it possible to reduce the athlete's response time to generate a correct voluntary muscular response, thus reducing the time for the anterior cruciate ligament to be damaged.

Another advantage of the sports shoe according to the present invention consists in that it ensures a correct stability of the fulcrum of the foot while favoring, moreover, the equilibrium of the athlete in the step of changing direction and grip, both when stopping and in traction, with respect to the ground.

Another advantage of the sports shoe according to the present invention consists in that it reduces the friction between the athlete's foot and the ground, thus contributing considerably to saving energy when restarting after a sudden stop in that the elastic return of the elastically deformable portion of the stud is exploited.

More precisely, a shoe with elastically deformable studs improves the athlete's overall performance in that the biomechanical fulcrum of the foot is moved closer to the point of thrust, i.e. in the direction of the change of direction, and not in the direction of the previous stroke.

The time to perform the body rotation movement and to complete a change of direction is moreover considerably lower than with shoes with studs of the conventional type, thus boosting the athlete's performance levels.

The sports shoe, particularly for soccer use and the like, thus conceived, is susceptible of numerous modifications and variations, all of which are within the scope of the appended claims.

Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. MI2011A002089 from which this application claims priority are incorporated herein by reference.

The invention claimed is:

1. A sport shoe, comprising: an upper and a sole which is provided with at least one stud, the at least one stud being associated with the sole by means of at least one elastically deformable element for the movement of at least part of the at least one stud about its own longitudinal axis in such a manner as to follow the movements of change of direction, traction and stopping of the athlete who is wearing the sports shoe, further comprising a stripping prevention element that lies inside the sole and the at least one stud, passing through the at least one elastically deformable element in order to prevent accidental breakages of the at least one elastically deformable element or the separation of the at least one stud during the use of the sports shoe, wherein the at least one elastically deformable element is defined by an elastically deformable collar element which has, at its axial ends, two elastically deformable radial flanges, the elastically deformable collar element passing from one side to the other of the sole by means of a through hole which is defined in the sole so that the sole remains interposed between the two elastically deformable radial flanges, one of the two elastically deformable radial flanges arranged inside the sports shoe and accommodated in a compartment which is defined in the compensation mid-sole of the sports shoe and the other of the two elastically deformable radial flanges arranged on the tread side of the sole being associated with the at least one stud; wherein the stripping prevention element is defined by a screw which is inserted in the elastically deformable element from the side of the elastically deformable radial flange arranged inside the sports shoe and is screwed into a respective threaded hole which is defined in the at least one stud; and wherein an angle between the traction surface of the sole and the longitudinal axis of the stud varies as the collar elastically deforms.

2. A sports shoe comprising: a sole having at least one through-hole formed therein; at least one elastically deformable collar extending through the through-hole in the sole, each elastically deformable collar having a first and second elastically deformable radial flanges, wherein the sole is disposed between the first and second elastically deformable flanges such that the first elastically deformable radial flange extends along an interior surface of the sole, the second elastically deformable radial flange extends along a tread surface of the sole, at least one stud coupled to the at least one elastically deformable collar, the elastically deformable collar allowing movement of the stud as the elastically deformable collar elastically deforms in reaction to forces applied to the stud; and a stripping prevention element that lies inside the sole extending through each elastically deformable collar and into each stud to retain the stud on the sole; wherein the stripping prevention element is defined by a screw which is inserted in the elastically deformable element from the side of the elastically deformable radial flange arranged inside the sports shoe and is screwed into a respective threaded hole which is defined in the at least one stud; and wherein an angle between the traction surface of the sole and the longitudinal axis of the stud varies as the collar elastically deforms.

3. The sports shoe according to claim 2, wherein the second flange is positioned between the tread surface of the sole and the stud.

4. The sports shoe according to claim 2, wherein the stripping prevention element comprise a screw inserted in the collar from the first radial flange and extending into the stud to engage a threaded hole defined in the stud.

5. A sports shoe comprising: a sole having a plurality of through-holes formed therein; a plurality of elastically deformable collar, one elastically deformable collar extending through ach of the plurality of holes, each elastically deformable collar having a first and second elastically deformable radial flanges having a diameter greater than the corresponding hole, the first elastically deformable radial flange positioned along an interior surface of the sole, the second elastically deformable radial flange positioned along a tread surface of the sole, a plurality of studs, each stud coupled to at least one of the plurality of elastically deformable collars, each elastically deformable collar allowing movement of each stud as each of the elastically deformable collars elastically deforms in reaction to force applied to each; and a stripping prevention element that lies inside the sole extending through each elastically deformable collar and into each stud; wherein the stripping prevention element is defined by a screw which is inserted in the elastically deformable element from the side of the elastically deformable radial flange arranged inside the sports shoe and is screwed into a respective threaded hole which is defined in the at least one stud; and wherein an angle between the traction surface of the sole and the longitudinal axis of the stud varies as the collar elastically deforms.

6. The sports shoe according to claim 5, wherein the second flange is positioned between the tread surface of the sole and the stud.

7. The sports shoe according to claim 5, wherein the stripping prevention element comprise a screw inserted in the collar from the first radial flange and extending into the stud to engage a threaded hole defined in the stud.

* * * * *